US007775943B2

(12) United States Patent
Vittone et al.

(10) Patent No.: US 7,775,943 B2
(45) Date of Patent: Aug. 17, 2010

(54) RESISTANCE BAND EXERCISE MACHINE

(76) Inventors: Suzanne R. Vittone, 5553 W. Center Dr., Hurley, WI (US) 54534; Larry W. Vittone, 5553 W. Center Dr., Hurley, WI (US) 54534; William M. Vittone, 127 Monticello Rd., Oak Ridge, TN (US) 37830

( * ) Notice: Subject to any disclaimer, the term of this patent is extended or adjusted under 35 U.S.C. 154(b) by 757 days.

(21) Appl. No.: 11/627,763

(22) Filed: Jan. 26, 2007

(65) Prior Publication Data

US 2007/0191197 A1 Aug. 16, 2007

Related U.S. Application Data

(63) Continuation-in-part of application No. 11/354,797, filed on Feb. 15, 2006, now Pat. No. 7,585,254.

(51) Int. Cl.
*A63B 22/00* (2006.01)

(52) U.S. Cl. ..... 482/70; 482/51; 482/126; 482/121

(58) Field of Classification Search ..... 482/51, 482/70, 121–126, 148; 434/247
See application file for complete search history.

(56) References Cited

U.S. PATENT DOCUMENTS 3,563,540 A * 2/1971 Hopfeld ..... 482/31
4,434,981 A * 3/1984 Norton ..... 482/70
5,104,119 A 4/1992 Lynch
5,110,117 A 5/1992 Fisher et al.
5,171,196 A 12/1992 Lynch
5,203,751 A 4/1993 Chang
5,279,532 A * 1/1994 Chen ..... 482/71
5,382,209 A 1/1995 Pasier et al.
5,405,305 A 4/1995 Wilkinson et al.
5,460,586 A 10/1995 Wilkinson et al.
5,476,431 A 12/1995 Wilkinson et al.
5,595,556 A 1/1997 Dalebout et al.
5,803,874 A 9/1998 Wilkinson
5,860,894 A 1/1999 Dalebout et al.
5,871,421 A 2/1999 Trulaske et al.
6,520,891 B1 2/2003 Stephens, Jr.
6,527,676 B1 * 3/2003 Frick et al. ..... 482/51
6,692,415 B1 * 2/2004 Winston ..... 482/126
6,723,028 B1 4/2004 Wang et al.
6,835,167 B2 12/2004 Schmidt
2005/0032613 A1 2/2005 Wehrell
2005/0124471 A1 6/2005 Wilkinson

* cited by examiner

*Primary Examiner*—Glenn Richman
(74) *Attorney, Agent, or Firm*—Luedeka Neely & Graham PC

(57) ABSTRACT

An exercise machine, including an elastic band and a tension fulcrum positioned so that the band extends around the tension fulcrum to provide resistance exercise to the user.

14 Claims, 11 Drawing Sheets

RESISTANCE BAND EXERCISE MACHINE

CROSS REFERENCE TO RELATED APPLICATIONS

This is a continuation-in-part of U.S. application Ser. No. 11/354,797 filed 15 Feb. 2006 now U.S. Pat. No. 7,585,254, entitled RESISTANCE BAND EXERCISE MACHINE, which is incorporated herein by reference in its entirety.

FIELD OF THE INVENTION

The disclosure relates generally to exercise devices. More particularly, the disclosure relates to exercise machines of the type utilizing resistance bands.

BACKGROUND AND SUMMARY OF THE INVENTION

Treadmills and other perambulatory exercise devices such as walkers, ellipticals, and the like often incorporate handles, poles or the like which are independently movable of one another for enabling the user to achieve additional exercise of the upper body. Weight lifting machines or other strength training apparatuses also incorporate various engagement members for a user to engage with the device. In one aspect, it has been discovered that significant improvements may be achieved to these various devices by incorporating one or more resistance bands into such exercise devices.

In this regard, one aspect of the disclosure relates to an improved exercise device of the type having independently movable handles which offers enhanced exercise attributes. In a preferred embodiment, the device includes an elongate handle member having a first portion pivotally mounted to a base, a second portion opposite the first portion configured for grasping by a user, and a resistance system operable with the handle.

The resistance system includes an elastic band having a first end portion connected to the elongate handle member adjacent the first portion of the handle, a second end portion fixedly positionable relative to the first end portion of the elastic band, and a tension fulcrum positioned so that the band extends around the tension fulcrum. As the elongate handle member is moved in a first direction the movement thereof is resisted by the band to provide resistance exercise to the user.

In other aspects, the resistance system may be adapted to a wide variety of exercise devices to provide resistance to exercise motion. In such devices, including treadmill and weight lifting devices, the exercise device includes a resistance system operably associated with a user engaging member to provide resistance exercise to a user during movement of said user engaging member by said user.

The resistance system includes an elastic band having a first end portion connected to said user engaging member, a second end portion fixedly positionable relative to the first end portion of the elastic band, and a tension fulcrum positioned so that the band extends around the tension fulcrum such that, as said user engaging member is moved in a first direction, the movement thereof is resisted by the band to provide resistance exercise to said user.

BRIEF DESCRIPTION OF THE DRAWINGS

Further features of preferred embodiments of the invention will become apparent by reference to the detailed description of preferred embodiments when considered in conjunction with the figures, which are not to scale, wherein like reference numbers, indicate like elements through the several views, and wherein.

DETAILED DESCRIPTION

Figure 1:
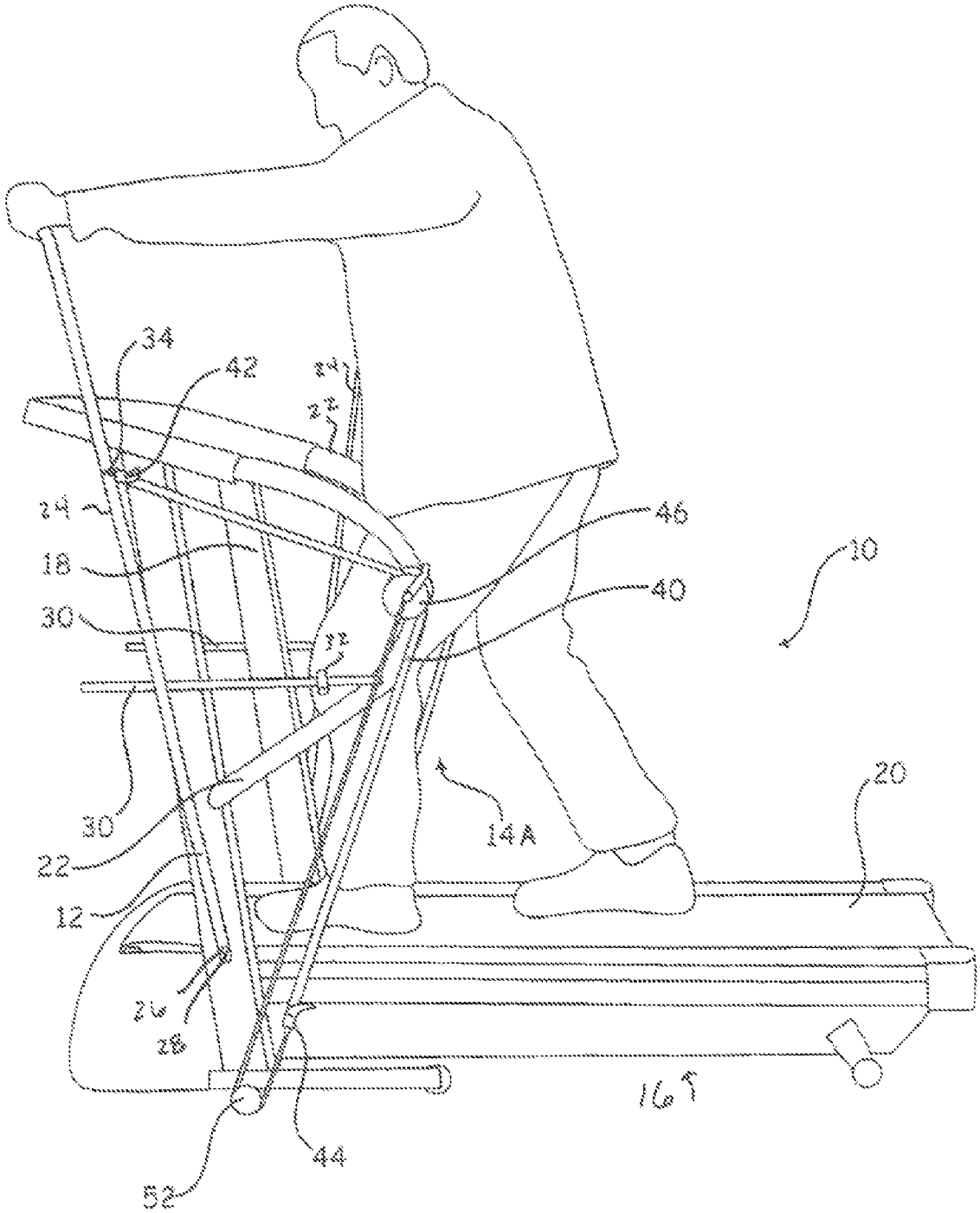
FIG. 1 is side view of an exercise device in accordance with one embodiment.
Figure 2:
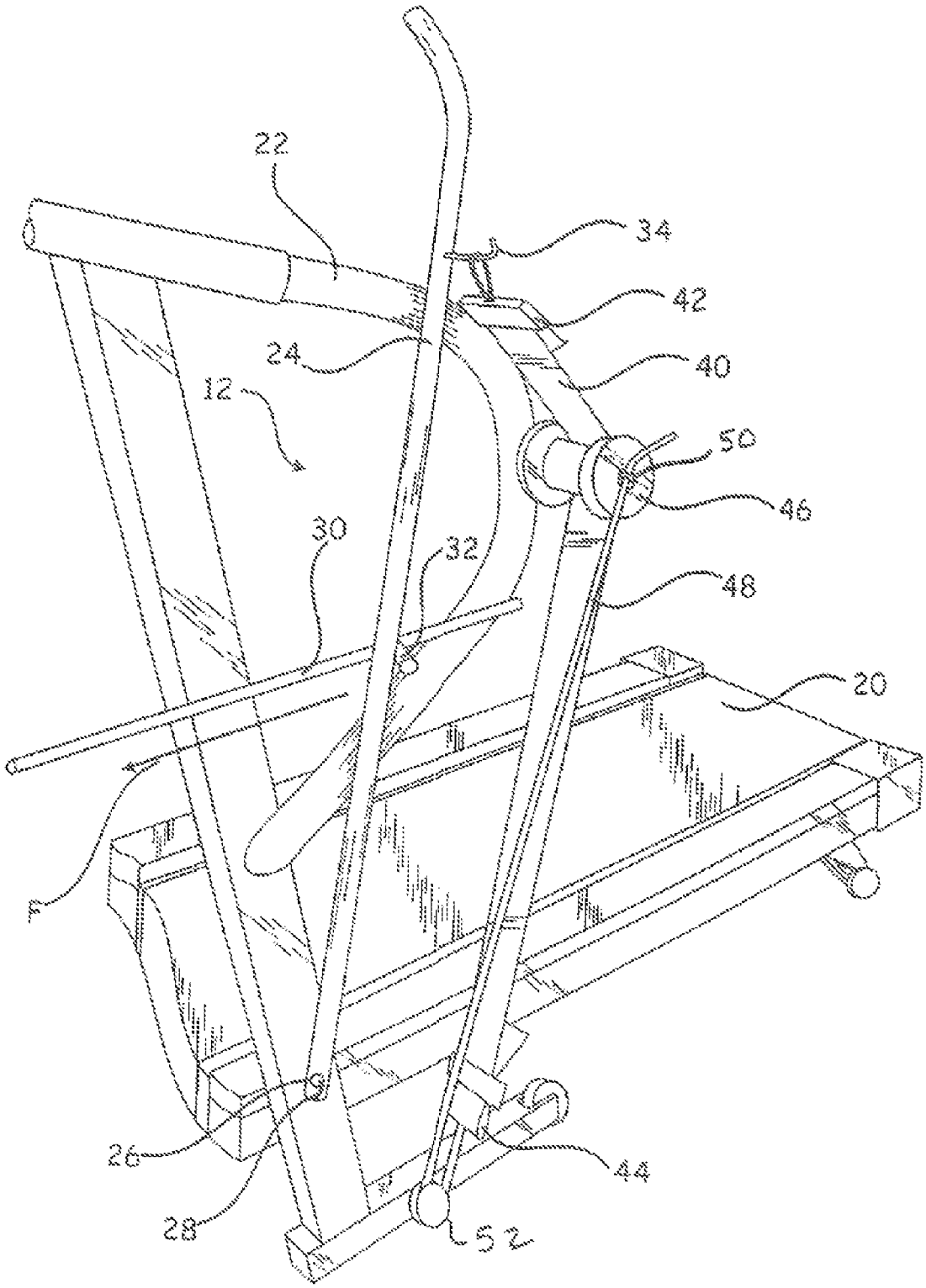
FIG. 2 is a close-up view of a handle and an associated resistance system of the device of FIG. 1.

With reference to FIGS. 1 and 2, there is shown an exercise machine 10 having one or more independently elongate handle members 12, and a resistance system 14A operatively associated with each of the members 12. The exercise machine 10 is shown as a treadmill 16 having a frame 18 supporting a movable tread 20 upon which a user is supported The treadmill 16 shown in FIG. 1 is a conventional treadmill of the type having an electrical motor driving the tread 20. The frame 18 of the treadmill 16 includes a pair of stationary handles 22. The treadmill 16 has been modified according to the disclosure to include the elongate handle members 12 and the resistance systems 14A, as described below.

The elongate handle members 12 may be provided as by poles 24 having a lower end portion 26 pivotally connected to a base, preferably provided by a portion of the frame 18 or other substantially immobile structure, as by a fastener, such as bolt 28. To limit the travel of the poles 24, rods 30 each having a stop 32 may be provided on the frame 18. An upper portion of each of the poles 24 is configured for grasping by the user. The user may grasp the poles 24 and independently pivot the poles 24 in a forward and rearward direction, with the forward extent of travel limited by the resistance systems 14A and the rearward extent of travel limited by the stops 32. An upper portion of each of the poles 24 preferably includes a connector 34, such as a hook or other projection for connection of the resistance systems 14A thereto.

As shown in FIGS. 1 and 2, each resistance system 14A preferably includes a resistance band 40 having a first end 42 connected to the pole 24 via the connector 34 and a second end 44 positioned so that the band 40 extends around a tension fulcrum 46, preferably provided as by a carriage roller rotatably secured to the stationary handle 22. In this regard, it is preferred that the tension fulcrum 46 be provided by a roller or the like such that when force is exerted by the user to stretch the band 40, the fulcrum 46 rolls the band 40 in the direction of the force exerted by the user. As a result, the band stretches more between the handle and the tension fulcrum than between the fulcrum and the opposite end of the band. This relative stretching has been observed to provide a smooth exercise motion for the user.

The tension fulcrum 46 is desirably positioned such that as the pole 24 is moved forward from a position corresponding to the location of the stop 32, as indicated by the arrow F (FIG. 2), the movement of the pole 24 is resisted by the band 40 to provide resistance exercise to the user. The end 44 may be secured in position to maintain the desired position of the band 40 around the tension fulcrum 46, such as by securing the end 44 to a lower end of the pole 24, to the frame 18, or other fixed point.

A desired pre-set tension may independently be applied to each of the bands 40 as by selecting an appropriate length of band material. In this regard, a preferred band material is made of synthetic rubber materials such as latex or other elastomeric rubber-like materials. Alternatively, a length of cable 48 may be connected to the end 44 of the band 40 and secured to a fixed point to apply a desired pre-set tension to the band 40. For example, a cable clamp 50 or other cable securing structure may be provided on the end of the fastener used to mount the tension fulcrum 46 or other fixed point for adjustably fixing the length of the cable 48 that extends between the end 44 of the band 40 and the clamp 50 to allow adjustment of the pre-set tension of the band 40. To facilitate this, a cable fulcrum 52, such as a pulley or the like may be secured to the frame 18 or other fixed point for positioning of the cable 44. In this regard, it will be understood that the pre-set tension of the band 40 is the tension of the band 40 when the pole 24 is at rest against the stop 32.

To use the machine 10, a user may stand on the tread 20 and grasp the poles 24 while performing a perambulatory motion to resist the movement of the tread. To enhance the exercise experience, the user may urge the poles 24, independently or simultaneously, or in an alternating fashion, in the direction of the arrow F as the user performs the perambulatory motion. It has been observed that such action by the user will provide resistance exercise for many body parts, including the arms, stomach, back, and legs to provide an overall exercise experience in excess of that experienced by simply resisting the motion of the tread 20 and not utilizing the poles 24. The pre-set tensions of the bands 40 may be adjusted to provide the desired resistance.

Figure 3:
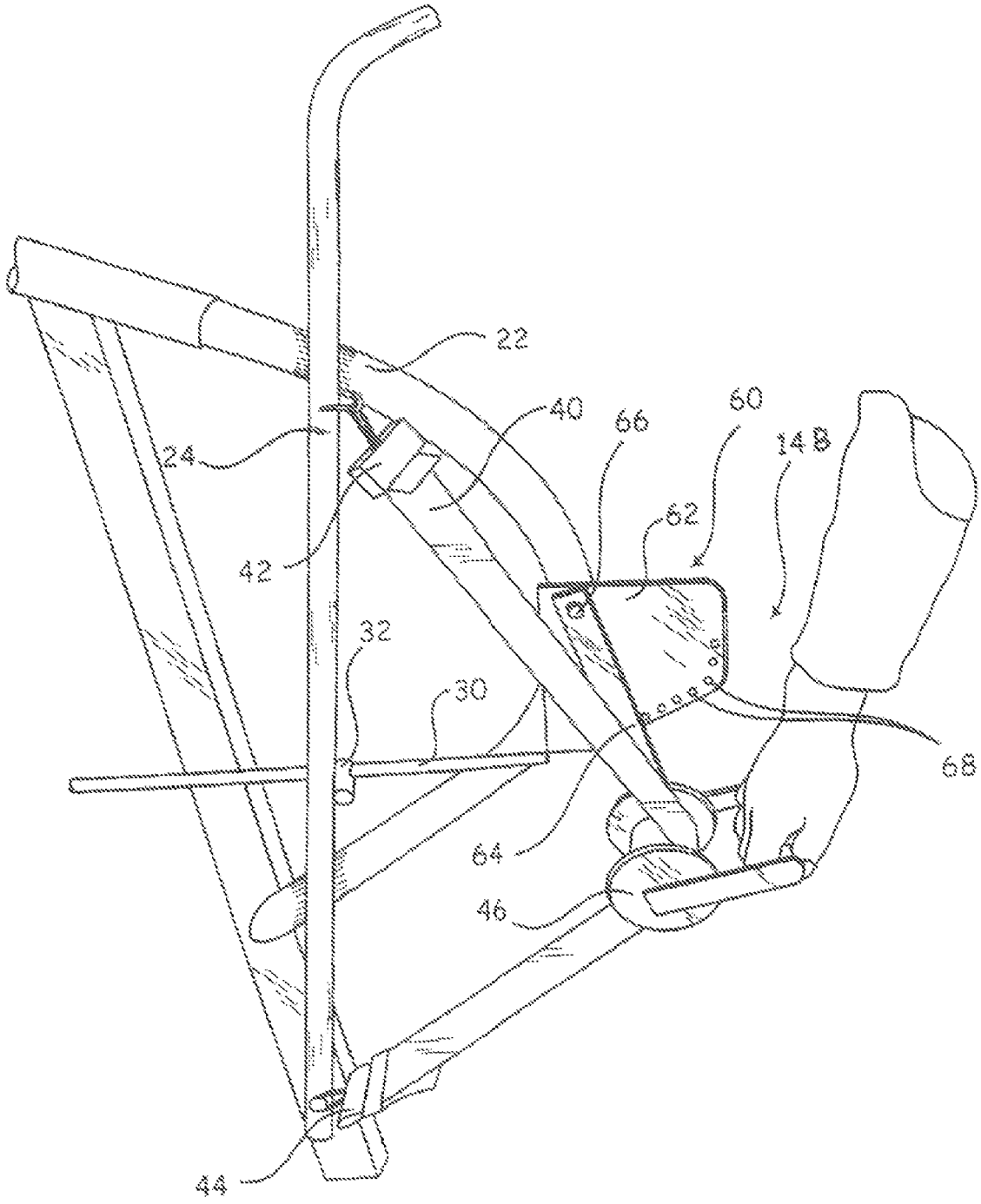
FIG. 3 shows an alternate embodiment of a resistance system.
Figure 4:
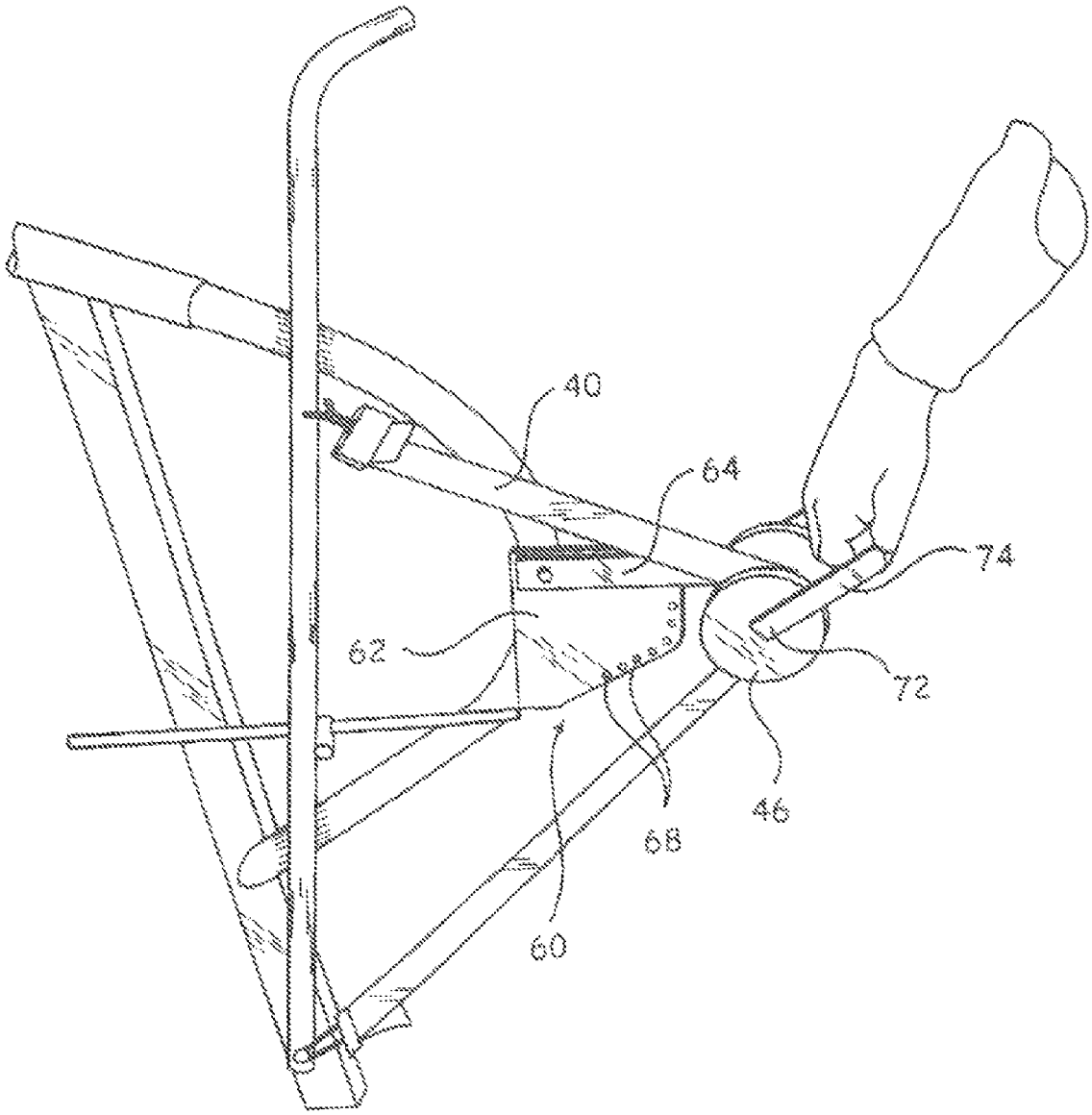
FIG. 4 is a close-up view of a portion of the resistance system of FIG. 4.

With reference now to FIGS. 3 and 4, there is shown an alternate embodiment of a resistance system 14B. The resistance system 14B is substantially similar to the resistance system 14A, except the position of the tension fulcrum 46 is adjustable. Also, as seen, the end 44 of the band 40 is secured to a fixed point, such as the lower end of the pole 24, or the frame 18, such that the cable 48 is not utilized.

In the embodiments shown in FIGS. 3 and 4, to enable adjustment of the position of the tension fulcrum 46, the resistance system 14B includes an adjustable fulcrum mount 60, preferably located on the handle 22 or other portion of the frame. The mount 60 includes a plate 62 secured to the handle 22 and a pivot member 64 pivotally mounted to the plate 62 as by a fastener 66 or the like. The plate 62 includes a plurality of apertures 68 for receiving a pin or other stop adjustably positionable within the apertures 68 to limit the downward travel of the pivot member 64. The pre-set tension of the band 40 is greater the higher the placement of the pin. For example, maintaining the fulcrum 46 at the position shown in FIG. 4 yields a greater pre-set position than does the fulcrum position depicted in FIG. 3.

The fulcrum 46 is preferably rotatably connected to the pivot member 64 as by a fastener 72, with a handle 74 preferably being included for enabling a user to grasp as seen in FIG. 4 to facilitate adjustment of the position of the fulcrum 46. That is, the user may grasp the handle 74 to pivot the member 64 upwardly away from the pin (against the resistance of the band 40) so that the pin may be relocated to a different one of the apertures 68, after which the handle 74 is released such that the tension of the band 40 urges the pivot member 64 against the pin.

Figure 5:
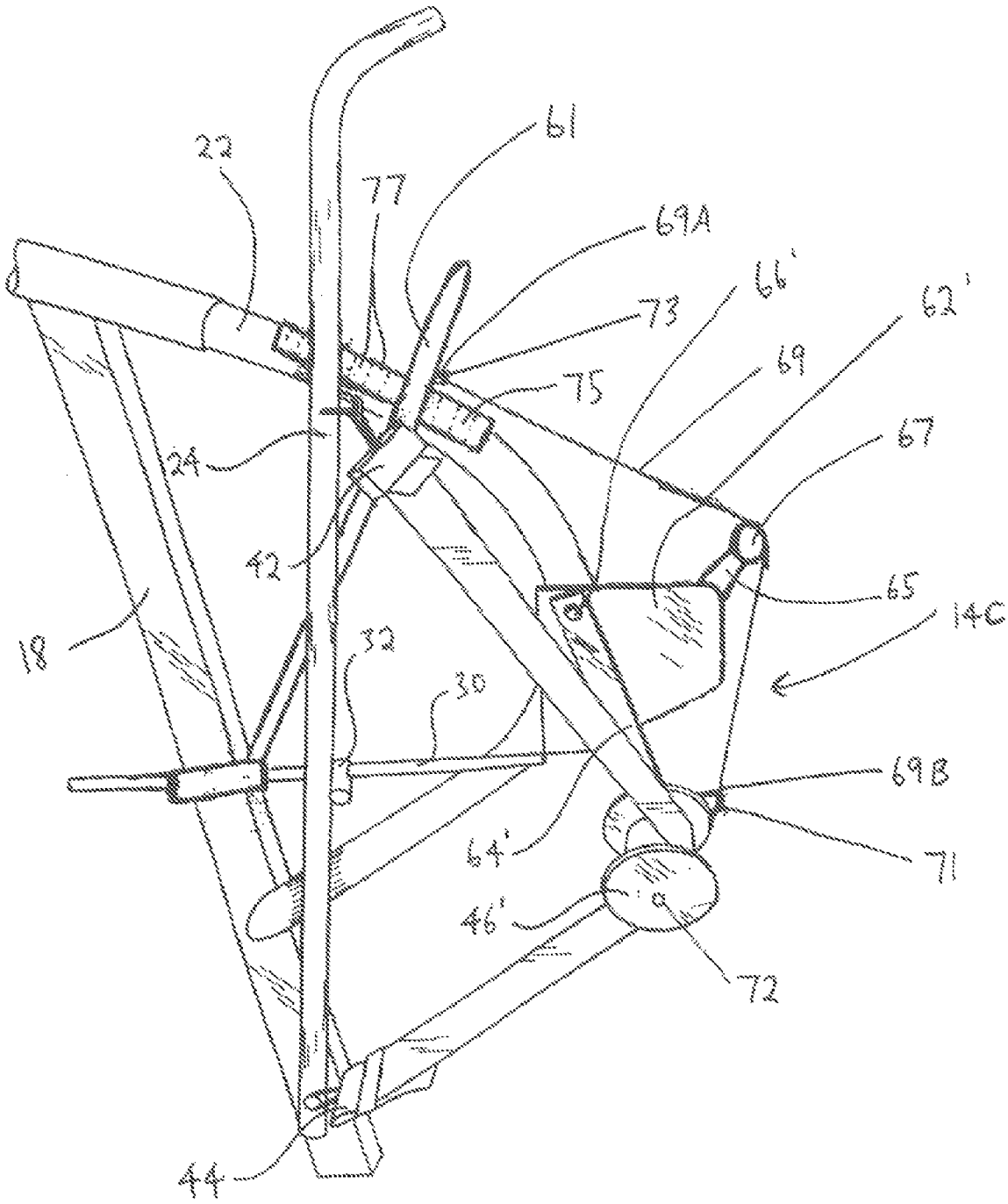
FIG. 5 shows a close-up view of a portion of an alternative embodiment of the resistance system.

FIG. 5 shows another embodiment having a resistance system 14C. To enable adjustment of the position of a tension fulcrum 46', the resistance system 14C includes an adjustable fulcrum mount 60', preferably located on the handle 22 or other portion of the frame, that is operatively attached to a movable elongate selection member 61. Selection member 61 is pivotally connected to a frame 18' by a fastener 63. The mount 60' includes a plate 62' secured to the handle 22 and a pivot member 64' pivotally mounted to the plate 62 as by a fastener 66' or the like. The plate 62' includes a pulley extension 65 with a pulley wheel 67. A strand 69, including a first strand end 69A and a second strand end 69B, is located along the pulley wheel 67, connecting the selection member 61 to the fulcrum 46.

The fulcrum 46 is connected to the strand 69 by a fastener 71, the fulcrum 46 is preferably rotatably connected to the pivot member 64 as by a fastener 72, and the first strand end 69A is connected to the selection member 61 by a fastener 73. As the selection member 61 is moved, the strand 69 is also moved, thereby moving the fulcrum 46 and ultimately adjusting the resistance force given by the band 40. A selection plate 75 is located along stationary handle 22, including selection member ports 77 for a user to selectively place the selection member 61 at rest along the stationary handle 22. This embodiment of resistance system 14B allows for a user to quickly and easily adjust the amount of resistance given by resistance system 14' during exercise.

Figure 6:
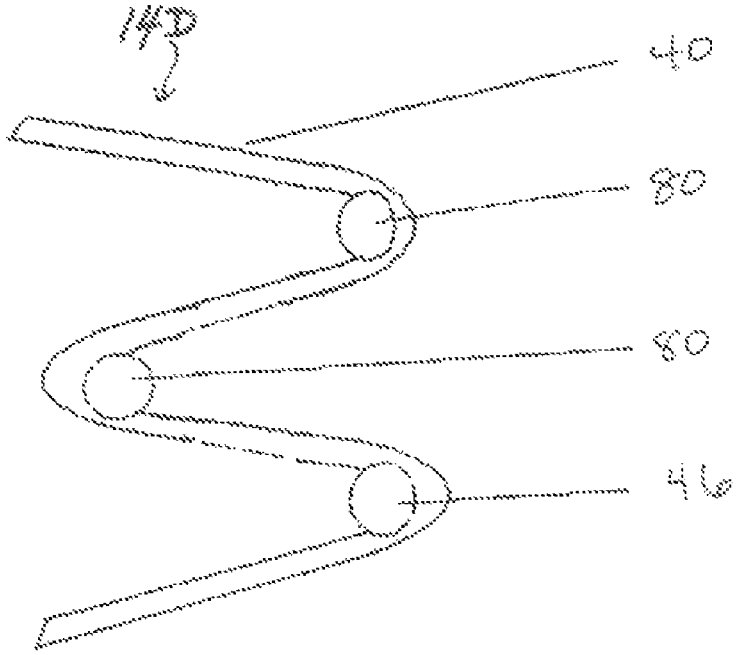
FIG. 6 shows a further embodiment of a resistance system.

With reference to FIG. 6, there is shown an alternate embodiment of a resistance system 14D. The resistance system 14D is substantially similar to the previously described resistance systems, except that the band 40 travels around one or more additional rollers 80 in addition to the tension fulcrum 46 to render the band in a substantially compact, such as serpentine, configuration. As will be appreciated, this configuration enables the use of a relatively long band in a compact space. Thus, this configuration of a resistance system is particularly configured for compact exercise machines.

Figure 7:
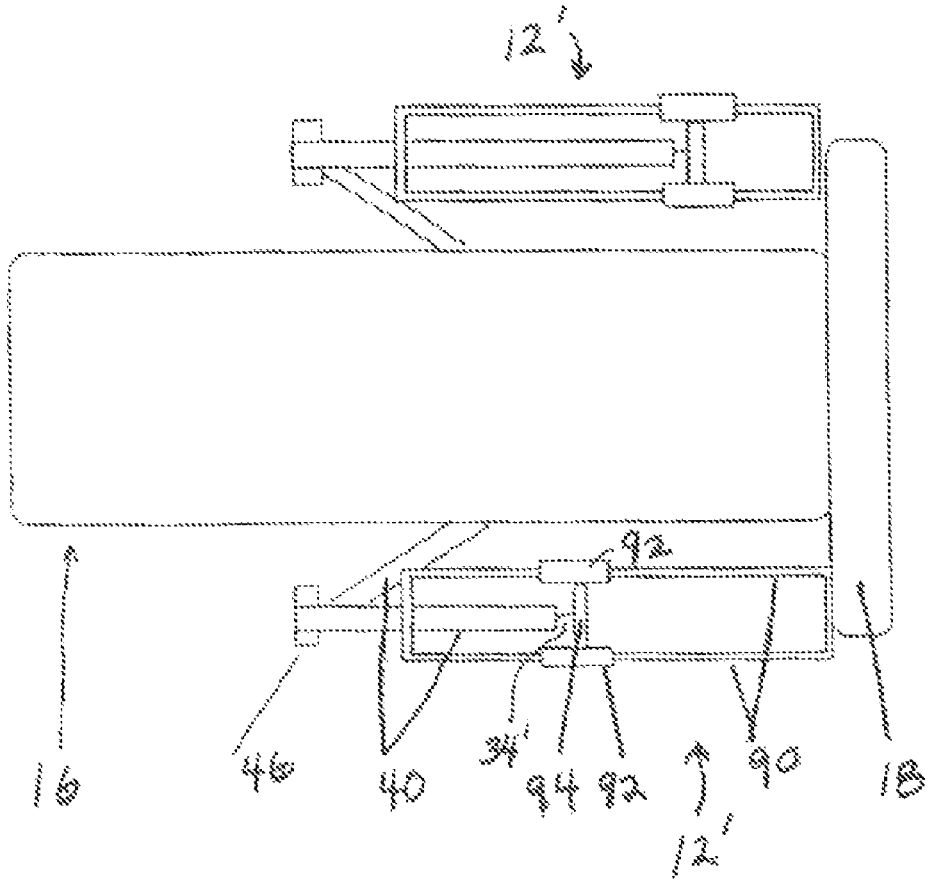
FIG. 7 is a top plan view of another embodiment of an exercise machine having sliding handle members.

With reference to FIG. 7, there is shown an alternate embodiment of an exercise machine which substantially corresponds to the exercise machine 10, but having handle system 12' instead of handles 12. The handle system 12' includes slides 90 which slidingly travel along guides 92 mounted to the frame 18. A hand grip 94 extends between the slides 90 for grasping by a user. The slides 90 may be provided as by cylinders, preferably including interior bearings, which travel along the guides 92, which may be rods, for example. The end of the band 40 of the resistance system 14A, 14B, 14C, or 14D may be connected to the hand grip 96 as by connector 34', which may correspond to the connector 34.

While the exercise machines are described herein as a treadmill, it will be understood, that the exercise machines may be of other configuration such as an elliptical machine or stationary bicycle or stair climber or the like. The exercise machine 10 may also be otherwise configured, such as a weight lifting or resistance exercise device, with the resistance system incorporated to provide or enhance exercise resistance.

In the various configurations of the exercise machine, it will be understood that the exercise device includes a user engaging member with which a user interacts with during performance of an exercise. For example, the handle members 12 or other user engaging devices such as a pull handle or leg engaging member or the like with which the user interacts for exercise. A resistance system is operably associated with the user engaging member to provide resistance exercise to the user during movement of the user engaging member by the user.

The resistance system includes an elastic band having a first end portion connected to the user engaging member, a second end portion fixedly positionable relative to the first end portion of the elastic band, and a tension fulcrum positioned so that the band extends around the tension fulcrum such that as the user engaging member is moved in a first direction the movement thereof is resisted by the band to provide resistance exercise to the user. In alternate embodiments, the first end portion of the elastic band may be connected to a strand (or strands) that is further connected to the user engaging member. For the purposes of this disclosure, a "strand" may be any elongate member capable of spatial manipulation such as, for example, a cable, a rope, and other similar structures. Additionally or alternatively, the second end portion of the elastic band may be connected to a strand (or strands) that is further fixedly positionable relative to the first end portion of the elastic band.

Figure 8:
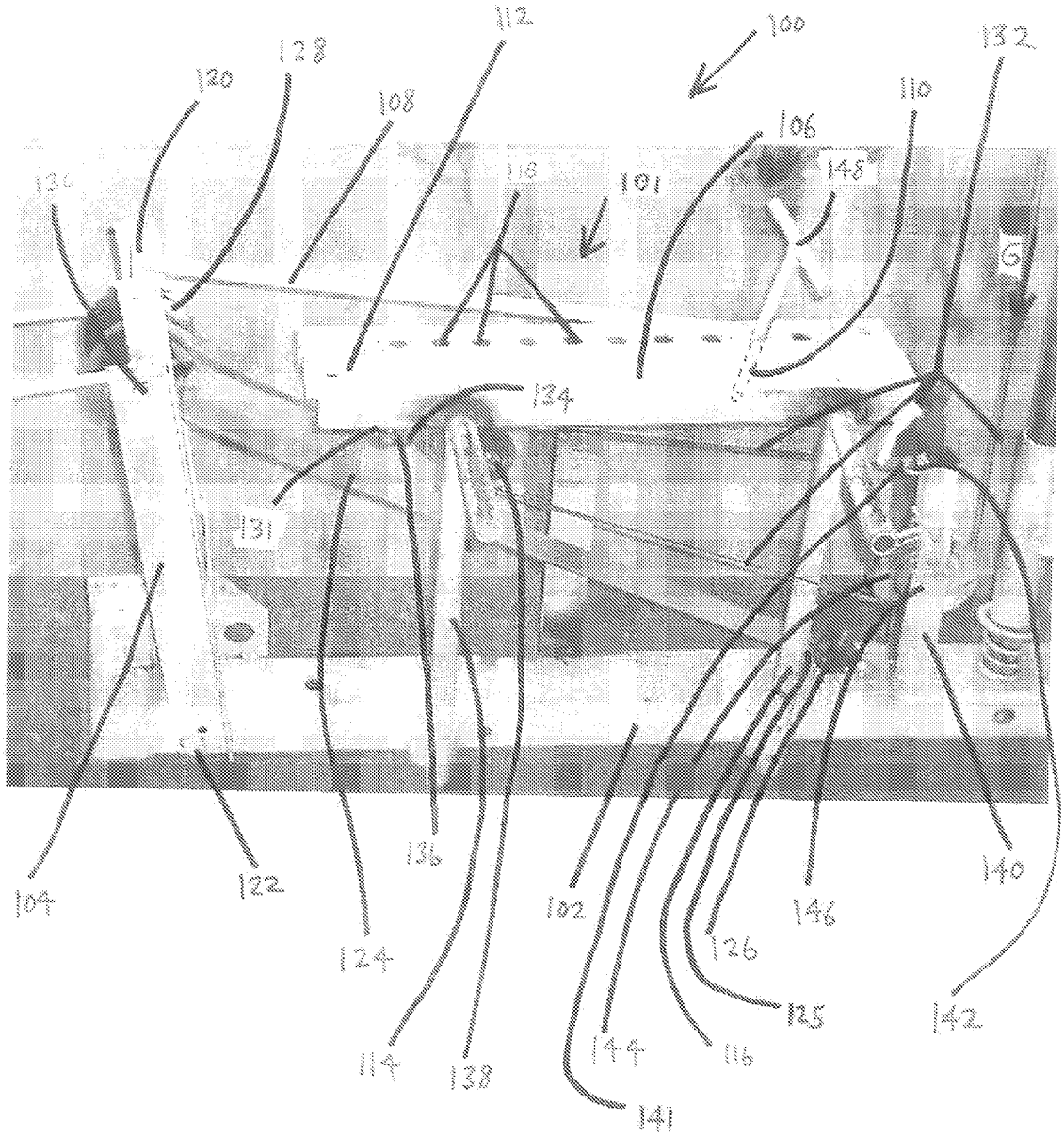
FIG. 8 is a perspective view of an exercise device in accordance with another embodiment of the invention.

In an embodiment shown in FIG. 8, an exercise device 100 is shown including a resistance system 101. The resistance system 101 further includes a base member 102, an adjustable elongate pivot member 104, a frame 106, and an elongate connector member 108 including extension 110. The frame 106 further includes first frame member 112, first frame support 114 and second frame support 116. First frame member 112 includes selection ports 118 whereby extension 110 may be selectively connected to frame member 112. Connector member 108 is movably connected to pivot member 104 by a fastener 120, and pivot member 104 is pivotally connected to base 102 by a fastener 122. Frame 106 is attached to base 102, preferably by welding.

Figure 9:
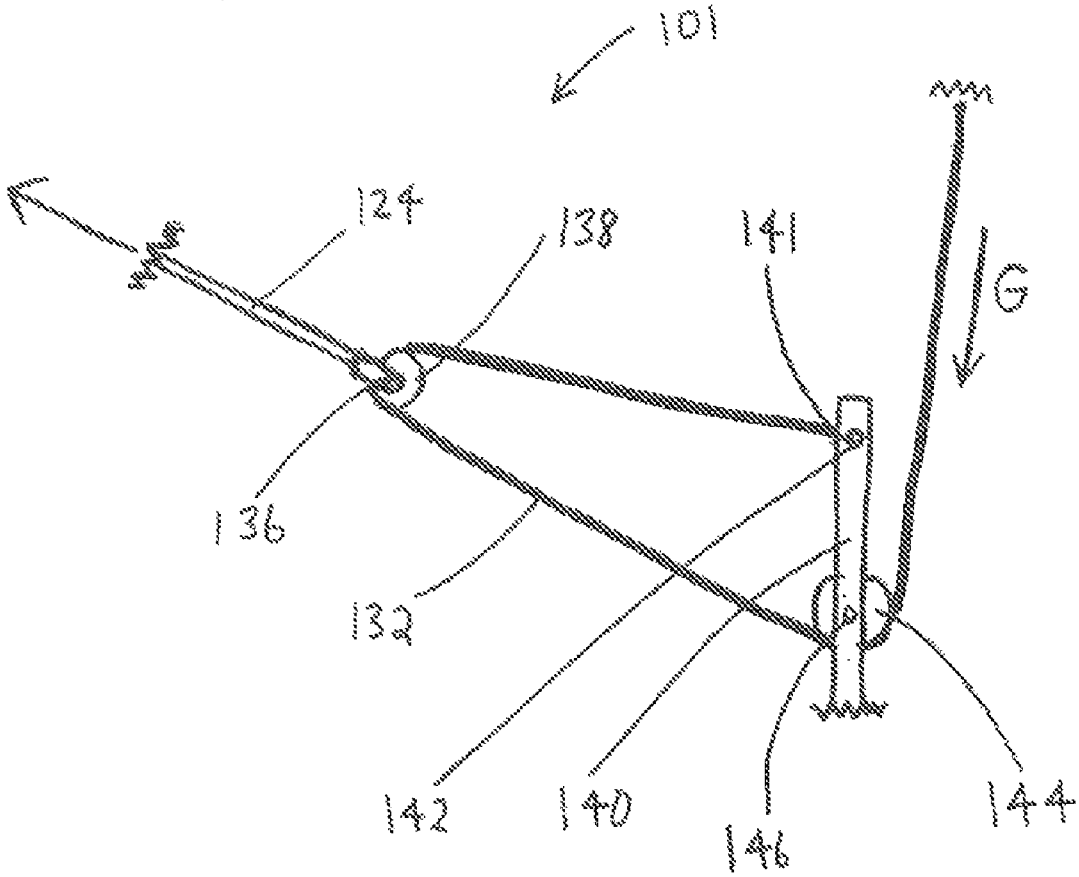
FIG. 9 is a close up view of a specific feature of the exercise device shown in FIG. 8.

The resistance system 101 shown in FIGS. 8 and 9 includes an elastic band 124. An elastic band first end 125 is connected to the base 102 by a fastener 126. A tension fulcrum 128 is connected (preferably movably connected) to pivot member 104 by a fastener 130. The elastic band 124 is positioned about tension fulcrum 128 and a second elastic band end 131 is connected to a strand 132 by a connector 134. The connector 134 shown in FIG. 8 includes a fastener 136 and a pulley wheel 138. A pivot extension 140 is connected to the base 102, preferably by welding. Strand 132 is positioned along pulley wheel 138, and a first strand end 141 is connected to the pivot extension 140 by a fastener 142. A second strand end (not shown) is connected to a user engaging member such as a hand grip, a bar, a foot securing device, or other similar user engaging member. Strand 132 is positioned about a pulley wheel 144 that is attached to the pivot extension 140 by a fastener 146.

As a user performs an exercise by moving an engaging member connected to the second strand end, a resistance force shown by arrow G operates against the user. The magnitude of the force F may be altered by moving extension 110 to a different selection port 118. The embodiment shown in FIG. 8 includes a handle 148 for easy movement of extension 110.

Figure 10:
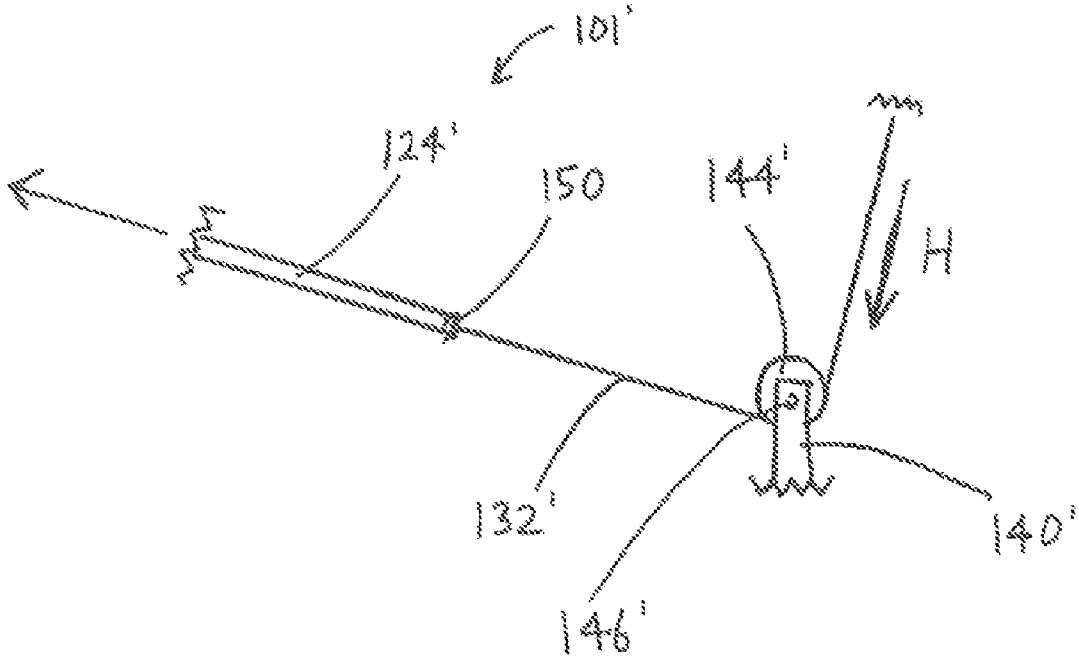
FIG. 10 is a close up view of a specific feature of an alternative embodiment of the exercise device shown in FIG. 8.

FIG. 10 shows an alternative embodiment including a resistance system 101' that further includes an elastic band 124' attached to a strand 132' by a fastener 150. The resistance system 101' also includes a pulley wheel 144' attached to a pivot extension 140' by a fastener 146'. The strand 132' is positioned along the pulley wheel 144' and a resistance force H operates against a user if an engaging member is moved during exercise.

Figure 11:
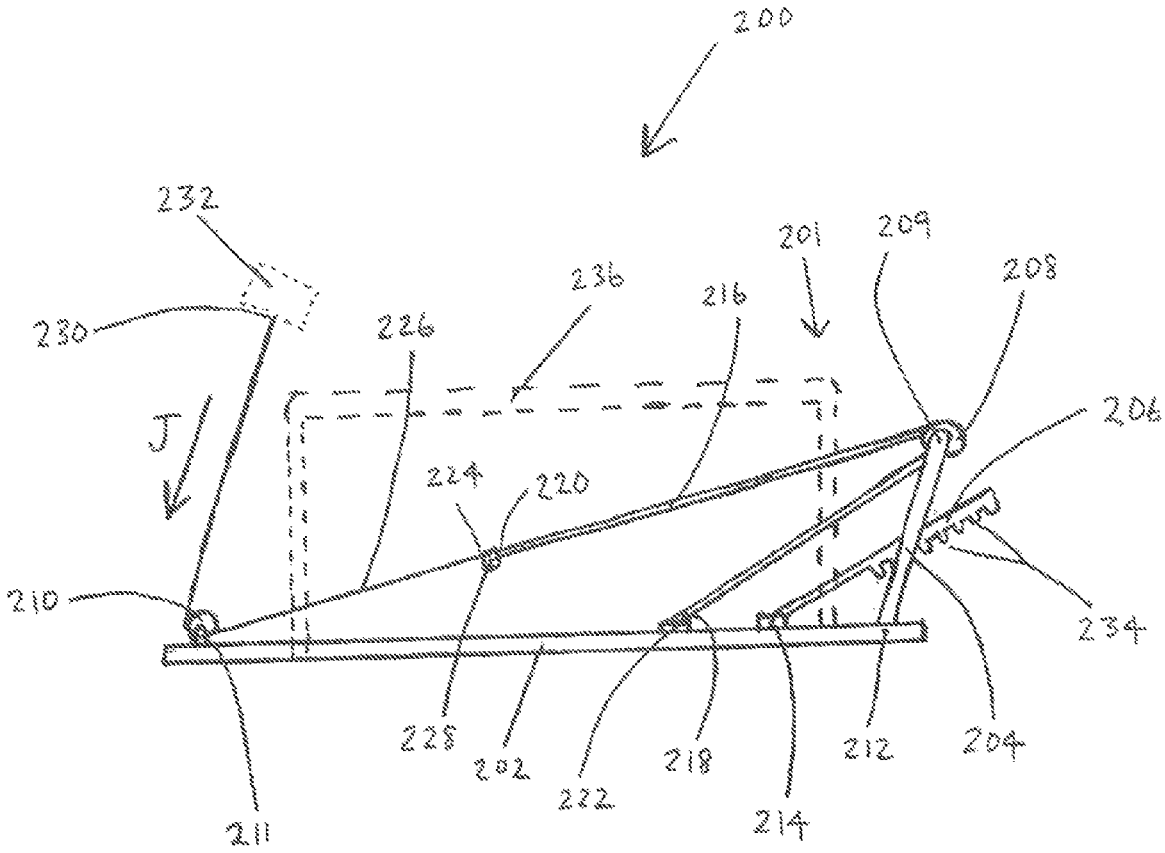
FIG. 11 is a side view of an exercise device in accordance with another embodiment of the invention.

Another embodiment of the invention is shown in FIG. 11 including exercise device 200 with resistance system 201. The resistance system 201 includes a base 202, an elongate pivot member 204, and extension member 206, a first pulley wheel 208, and a second pulley wheel 210. Those skilled in the art appreciate that three or more pulley wheels may be used in this or related embodiments. The first pulley wheel 208 is connected to the pivot member 204 by a fastener 209, and the second pulley wheel 210 is connected to the base 202 by a fastener 211. The pivot member 204 is pivotally connected to the base 202 by a fastener 212, and the extension member 206 is movably connected to the base 202 by a connector 214.

The resistance system 201 also includes an elastic band 216 including a first elastic band end 218 and a second elastic band end 220. The first elastic band end 218 is preferably connected to the base 202 by a fastener 222. The second elastic band end 220 is connected to a first strand end 224 of a strand 226 by a fastener 228. A second strand end 230 is connected to a user engaging member 232. Alternatively, the elastic band 216 may be connected directly to the user engaging member 232. In yet another embodiment, the strand 226 (or the elastic band 216) may be connected to one or more intermediary structures that are, in turn, connected to the user engaging member 232. Those skilled in the art appreciate that strand 226 and user engaging member 232 are not necessary in every embodiment of the invention. When exercise device 200 is used, a user acts on the user engaging member 232, and the elastic band stretches, resulting in a resistance force such as resistance force J shown in FIG. 11. The extension member 206 may be moved such that the pivot member 204 is adjusted, resulting in an increased or a decreased resistance force J. A plurality of protrusions 234 allow for the pivot member to be held in place at a particular positional setting.

A workout bench 236 is also shown for exemplary purposes to give some perspective as to how this embodiment of the invention may be oriented with other exercise equipment. However, those skilled in the art appreciate that variations on this embodiment may come in different sizes and be oriented in different manners with different types of exercise equipment.

Figure 12:
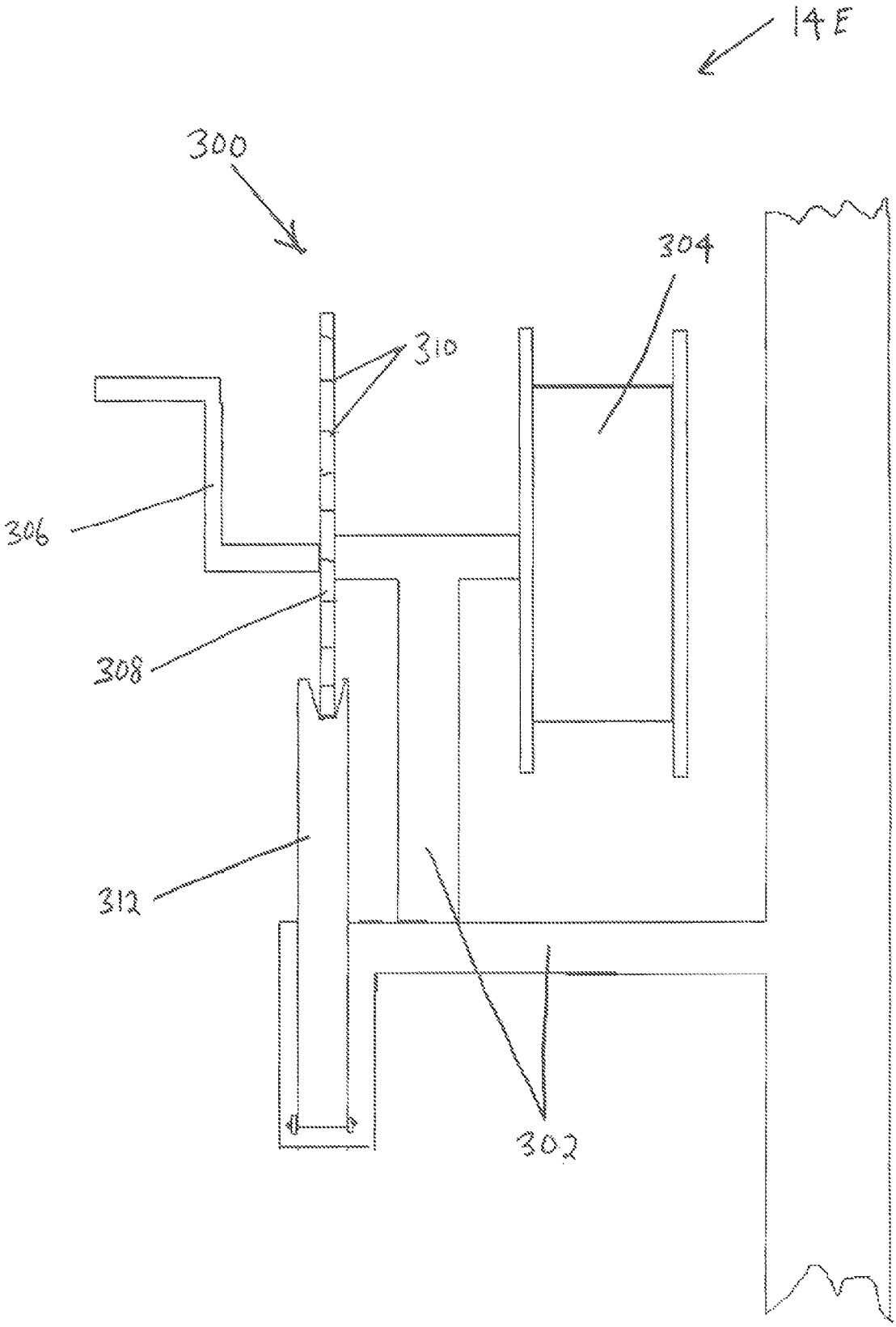
FIG. 12 is a close up view of a portion of one embodiment of a resistance system as used in various embodiments of the invention.
Figure 13:
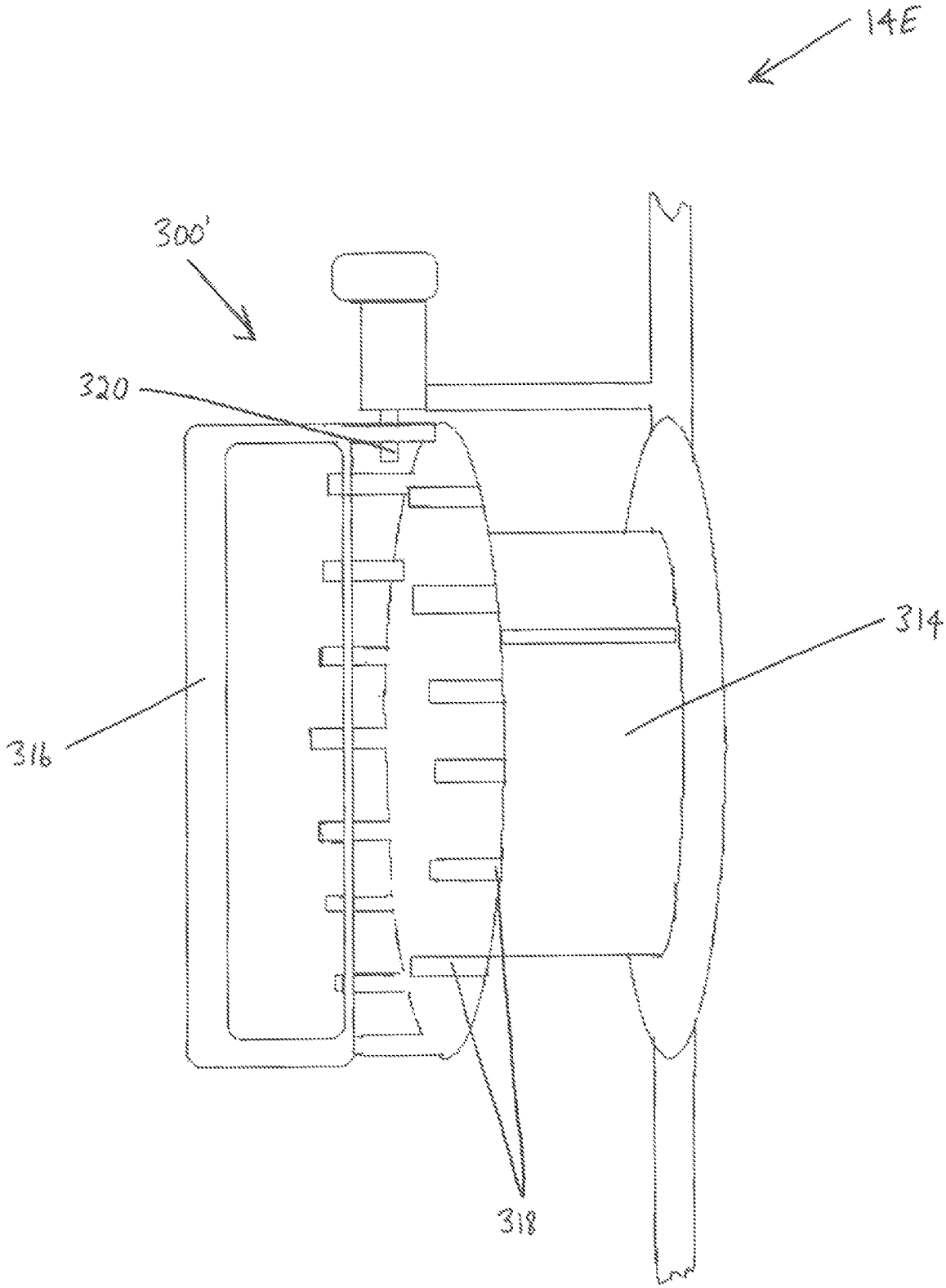
FIG. 13 is a close up view of a portion of one embodiment of a resistance system as used in various embodiments of the invention.

With reference to FIGS. 3-5, 12, and 13, other embodiments of the invention including part of resistance system 14E are shown. Resistance system 14E allows for the direct adjustment of the tension in the resistance band by using an accumulation member such as a reel 300 as shown in FIG. 12 instead of or in addition to the adjustable positioning of the tension fulcrum (46 or 46'). An alternate version of the reel 300 is shown in FIG. 13 including reel 300'. The reel 300 or 300' may be positioned at either end of the resistance band, fixedly connected to an exercise machine incorporating resistance system 14B, 14C, or 14D to allow for the resistance of the resistance band to be selectively increased or decreased. The fulcrum (46 or 46') may remain selectively positionable as shown in FIGS. 3-5 or, alternatively, the fulcrum (46 or 46') may be fixed and the accumulation member determine the increased or decreased resistance of the resistance band.

As shown in FIG. 12, reel 300 includes a reel frame 302, a spool 304 for attachment and accumulation of the resistance band, a crank 306 including gear member 308 including individual extension members 310, and a catch member 312 movably connected to the reel frame 302 for selectively catching the gear member 308 along its individual extension members 310.

Reel 300' as shown in FIG. 13 includes a spool 314 including handle 316 for rotating the spool 314 and extenders 318, and a catch member 320 for holding the tension of the resistance band at a desired level along extenders 318. Those skilled in the art appreciate that various embodiments of the invention include other structures for fixedly accumulating resistance band to increase tension other than reel 300 or 300'.

The foregoing description of certain exemplary embodiments of the present invention has been provided for purposes of illustration only, and it is understood that numerous modifications or alterations may be made in and to the illustrated embodiments without departing from the spirit and scope of the invention.

The invention claimed is:

1. An exercise device, comprising:

an adjustable resistance system to provide resistance exercise including an elastic band extending partially around a tension fulcrum, the elastic band having a first end portion and a second end portion fixedly positionable relative to the first end portion, the tension fulcrum positioned so that as the first end portion is moved in a first direction, the movement thereof is resisted by the elastic band to provide resistance exercise, wherein the tension fulcrum is adjustably positionable to adjust a preset tension of the elastic band.

2. The exercise device of claim 1, wherein the elastic band is connected to at least one strand, wherein the at least one strand is further connected to an accumulation member.

3. The exercise device of claim 1, wherein the elastic band is connected to at least one strand, wherein the at least one strand is further connected to a user engaging member.

4. The exercise machine of claim 1, wherein the tension fulcrum comprises a roller and when force is exerted to stretch the band, the fulcrum rolls the band so that the band stretches more between the first end portion of the band and the tension fulcrum than between the fulcrum and the second end portion of the band.

5. The exercise device of claim 4, wherein the band is positioned around two or more rollers.

6. An exercise device, comprising: an adjustable resistance system to provide resistance exercise including a base; an elastic band having a first end portion and a second end portion fixedly positionable relative to the first end portion; a pivot member pivotally connected to the base; an extension member movably connected to the pivot member; a tension fulcrum connected to the pivot member to adjust a pre-set tension of the elastic band, positioned so that the elastic band extends partially around the tension fulcrum such that as the first end portion is moved in a first direction the movement thereof is resisted by the elastic band to provide resistance exercise; and a selection member whereon the extension member may be selectively engaged to influence the position of the pivot member, thereby, influencing the position of the tension fulcrum and ultimately adjusting the pre-set tension of the elastic band.

7. The exercise machine of claim 6, wherein the elastic band is made of an elastomeric material.

8. The exercise device of claim 6, wherein elastic band first end portion is connected to a user engaging member.

9. The exercise device of claim 6, wherein elastic band is connected to an accumulation member.

10. The exercise machine of claim 6, wherein the tension fulcrum comprises a roller and when force is exerted to stretch the band, the fulcrum rolls the band in the direction of the force exerted so that the band stretches more between the first end portion of the band and the tension fulcrum than between the fulcrum and the second end portion of the band.

11. The exercise device of claim 6, wherein the band is positioned around two or more rollers.

12. An exercise device, comprising: an adjustable resistance system to provide resistance exercise including a base; an elastic band having a first end portion and a second end portion fixedly positionable relative to the first end portion; a pivot member pivotally connected to the base; an extension member, movably connected to the base and selectively engagable with the pivot member; and a tension fulcrum connected to the pivot member to adjust a pre-set tension of the elastic band, positioned so that the elastic band extends partially around the tension fulcrum such that as the first end portion is moved in a first direction the movement thereof is resisted by the elastic band to provide resistance exercise; wherein the selective engagement of the extension member with the pivot member influences the position of the pivot member, thereby, influencing the position of the tension fulcrum and ultimately adjusting the pre-set tension of the elastic band.

13. The exercise device of claim 12, wherein elastic band first end portion is connected to a user engaging member.

14. The exercise device of claim 12, wherein elastic band is connected to an accumulation member.

* * * * *